US010792698B2

(12) United States Patent
Warren

(10) Patent No.: US 10,792,698 B2
(45) Date of Patent: Oct. 6, 2020

(54) HEATED EPOXY CARTRIDGES

(71) Applicant: Philip Warren, Carver, MA (US)

(72) Inventor: Philip Warren, Carver, MA (US)

(73) Assignee: Warren Environmental & Coating, LLC, Middleborough, MA (US)

( * ) Notice: Subject to any disclaimer, the term of this patent is extended or adjusted under 35 U.S.C. 154(b) by 471 days.

(21) Appl. No.: 15/338,346

(22) Filed: Oct. 29, 2016

(65) Prior Publication Data

US 2017/0120270 A1 May 4, 2017

Related U.S. Application Data

(60) Provisional application No. 62/248,089, filed on Oct. 29, 2015.

(51) Int. Cl.
*F27D 11/00* (2006.01)
*B05C 17/005* (2006.01)
*H05B 3/40* (2006.01)

(52) U.S. Cl.
CPC ..... *B05C 17/00553* (2013.01); *H05B 3/40* (2013.01)

(58) Field of Classification Search
CPC ..... B05C 17/00553; H05B 3/40–48; H05B 3/54; H05B 3/56–565; H05B 3/58
USPC ..... 219/428, 534–537, 542–548
See application file for complete search history.

(56) References Cited

U.S. PATENT DOCUMENTS 4,421,973 A * 12/1983 Lou ..... H05B 3/00 219/214
4,493,436 A * 1/1985 Brokaw ..... B05C 17/00553 222/137
4,725,713 A * 2/1988 Lehrke ..... G05D 23/19 392/472
4,955,721 A * 9/1990 Clark ..... C04B 28/36 219/388
5,009,941 A * 4/1991 Pollet ..... B29C 53/845 138/123
5,026,187 A * 6/1991 Belanger ..... B05C 17/00533 219/230
5,248,068 A * 9/1993 Goergen ..... B05C 17/00553 222/135
5,932,129 A * 8/1999 Hyatt ..... A61F 7/007 126/263.01

(Continued)

*Primary Examiner* — Sang Y Paik
(74) *Attorney, Agent, or Firm* — Barlow, Josephs & Holmes, Ltd.

(57) ABSTRACT

An improved cartridge structure that both heats the materials contained therein and provides for enhanced structure such that the bypass leaking of the low viscosity heated components is avoided. The cartridge is preferably formed from a rigid material such as reinforced fiberglass tubing. The wall of the cartridge is then wrapped in a flexible heating element or has a heating element cast directly in the wall thereof. The heating elements preferably heat the interior contents and epoxy cartridges to between 150 degrees and 180 degrees Fahrenheit. The wall structure may be of single wall construction with the heaters embedded therein or of a double wall construction such that the heaters are contained between an inner and outer wall. Further the wall construction is preferably formed to withstand the pressures applied when spray applying the epoxy contained therein to prevent the tube wall deformation and resulting blow by leakage.

12 Claims, 2 Drawing Sheets

(56) References Cited

U.S. PATENT DOCUMENTS

| | | | | |
|---|---|---|---|---|
| 6,439,438 | B1 * | 8/2002 | Schouten | B05C 17/00533 222/1 |
| 7,209,651 | B1 * | 4/2007 | Knoeppel | F24H 9/2021 219/482 |
| 2011/0056931 | A1 * | 3/2011 | Schlipf | B29C 45/2737 219/548 |

* cited by examiner

HEATED EPOXY CARTRIDGES

CROSS-REFERENCE TO RELATED APPLICATIONS

This application is related to and claims priority from earlier filed US Provisional Patent Application No. 62/248,089, filed Oct. 29, 2015.

BACKGROUND OF THE INVENTION

The present invention generally relates to self-heating cartridges containing two-part and/or self-setting compositions prior to their application. More specifically, the present invention relates to a system for efficiently and conveniently preheating prefilled cartridges containing viscous materials such as epoxies, caulking and the like to a temperature that promotes their smooth mixing and application as well as promoting a self-setting reaction.

Cartridges containing viscous materials such as caulking and a variety of two part materials in which mutually reactive liquids need to be mixed prior to their application. A preheating system is needed for maintaining the resin component or any of the components that must be in a preheated ready to use state so that when they are pumped into the system as separate components, they are already preheated so that the application process can begin immediately and continue as desired without delays.

Generally, epoxy coatings are well known in the art and due to their exceptional durability and structural properties epoxy based protective coatings have gained commercial acceptance as protective and decorative coatings for use on a wide variety of materials. For example, epoxy based protective coatings represent one of the most widely used methods of corrosion control. They are used to provide long term protection of steel, concrete, aluminum and other structures under a broad range of corrosive conditions, extending from atmospheric exposure to full immersion in highly corrosive environments. Further, epoxy coatings are readily available and are easily applied by a variety of methods including spraying, rolling and brushing. They adhere well to steel, concrete and other substrates, have low moisture vapor transmission rates and act as barriers to water, chloride and sulfate ion ingress, provide excellent corrosion protection under a variety of atmospheric exposure conditions and have good resistance to many chemicals and solvents. As a result, numerous industries including maintenance, marine, construction, architectural, aircraft and product finishing have adopted broad usage of epoxy coating materials.

The most common material utilized in the epoxy coating industry today is a multi-part epoxy material. In general, the epoxy includes a first base resin matrix and at least a second catalyst or hardener, although other components such as a pigment agent or an aggregate component may also be added. While the two parts remain separate, they remain in liquid form. After the two parts are mixed together, they begin a curing process that is typically triggered by exposure to heat, humidity or an ultra-violet light source, whereby the mixed material quickly begins to solidify. As a result, it is necessary to mix only a sufficient amount of compound such that it can be worked effectively before set up occurs. Accordingly, the use and application of these compounds is a tedious, slow and expensive proposition.

One such material, AQUATAPDXY (A-5 or A-6), is a proprietary, two-part self-setting compound which is designed to be applied under water or to wet surfaces. The product hardens into a ceramic like material which is resistive to chemical attack. This will set up into a coating that is smooth, hard and difficult to break or chip. This product, like most prior art coatings, has been difficult to use due to the preferred method of spray application. When attempting to spray apply an epoxy, two drawbacks are encountered. First, the material cannot be mixed in large batches prior to application because of the short pot life of the material. Accordingly, it must be mixed on an as needed basis immediately prior to spray application. Second, the naturally viscous consistency of the mixed epoxy material is not well suited for spray application.

To thin the epoxy to the consistency required for typical prior art spray application, the epoxy must be loaded with a large percent by volume of solvent. Such a solvent typically contains high level of volatile organic compounds (VOC) whose primary function is to lower viscosity thereby providing a consistency suitable for spray application with conventional air, airless and electrostatic spray equipment. The addition of the solvent to the epoxy coating material in turn greatly increases the VOC content of the epoxy coating material and reduces the build thickness of the finished and cured coating.

Accordingly, some advancement in applications technology has been developed. Among them are systems for controlling mixing and viscosity. While these systems have provided great advancements in use of some sealing compounds, there is still great room for improvement.

One example of an improvement discloses a spray application system and method for a two-part, self-setting compound, and provides needed advancement of application technology, opportunities for improvement remain. For example, in some instances, multiple coats of compound may be required. More specifically, due to the nature of a mixture of compounds that may be in use, a desired finish may not be attainable if the compounds are applied too thickly. Applying multiple coats necessarily requires additional time and energy, and therefore can be costly.

In contrast, attempts to apply a thick coating typically result in slumping of compound and may require considerable rework. In some environments, such as with underground piping, misapplication can be virtually disastrous.

In short, now that techniques for applications have been greatly improved, there are opportunities to further refine compounds suited for various applications. Thus, what is needed are methods and apparatus for efficiently applying sealing compounds in a production environment. Preferably, the methods and apparatus provide for a much thicker coating of material than previously achievable. Further, it is desirable to have methods and apparatus that enhance the variety of sealing compounds that may be applied and the increase applications for which the compounds may be used.

In view of the foregoing, there is a need for a method and system for controlling the viscosity and temperature of a two-part, self-setting composition in a manner that operates efficiently and allows superior spray application of the material.

BRIEF SUMMARY OF THE INVENTION

In this regard, the present invention relates to a heating assembly that is formed as an integrated part of pre-loaded two part epoxy cartridges that heats them in a controlled manner for spray application. Further, the heating assembly is configured and arranged to be reinforced to resist pressure deformation and to facilitate easy spray application of material having a much higher viscosity than was possible in the prior art.

In the prior art epoxy is loaded into cartridges having two dispensing tubes arranged side by side wherein the size of the two tubes is proportional to the mixing formula of the epoxy wherein one tube is usually smaller and one is larger. This allows two cartridges to neatly nest with one another within a rectangular space wherein the cartridges are flipped relative to one another such that the larger diameter tubes are positioned adjacent the smaller diameter tubes. The cartridges are placed into a piston system that applies pressure to the plungers in the cartridges to force the epoxy out of the mixing nozzle end of the gun at elevated pressure. The prior art cartridges, when heated to the temperatures needed to reduce the viscosity of the epoxy material would undergo wall deformation and allow epoxy to leak at the rear of the cartridge past the plunger seals.

The present invention provides an improved cartridge structure that both heats the materials contained therein and provides for enhanced structure such that the bypass leaking of the low viscosity heated components is avoided. The cartridge is preferably formed from a rigid material such as reinforced fiberglass tubing. The wall of the cartridge is then wrapped in a flexible heating element or has a heating element cast directly in the wall thereof.

The heating elements can be rigid construction or of flexible construction as known in the art. The heating elements may be powered using conventional line voltage, i.e. 110 v, or through a car adapter operating at 12V DC. The heating elements preferably heat the interior contents and epoxy cartridges to between 150 degrees and 180 degrees Fahrenheit. More preferably the heating elements heat the contents of the cartridge to between 165 degrees and 180 degrees Fahrenheit.

The wall structure may be of single wall construction with the heaters embedded therein or of a double wall construction such that the heaters are contained between an inner and outer wall. Further the wall construction is preferably formed to withstand the pressures applied when spray applying the epoxy contained therein to prevent the tube wall deformation and resulting blow by leakage. Further the walls are constructed to retain their structural properties at the operational temperatures of the heated epoxy at or above 180 degrees Fahrenheit.

The cartridges heated in this manner are not subjected to burning as was the case in the use of prior art heating belts and is maintained in a heated useable form through the duration of the job while not requiring multiple cartridges to be heated one at a time prior to immediate use. In this manner the cartridges are maintained at the optimal temperature such that the contents are of a viscosity that spray application is uniform and consistent.

Accordingly, the present invention contemplates a new and improved apparatus and method for heating high build structural epoxy materials preparatory to use which overcomes all of the above referred problems and others. The device permits the material to be heated in a relatively short period of time. Furthermore, due to the configuration of the apparatus and method of heating, none of the material is burned; consequently the device is economically desirable.

It is therefore an object of the present invention to provide a method and system for preheating a spray-applying a two-part, self-setting composition that provides desired properties. It is a further object of the present invention to provide a method and system for preheating a delivery system for epoxy components that is particularly adapted for delivering the components of the composition at a temperature that promotes their spray application as well as a self-setting reaction.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Disclosed herein is a heating assembly that is formed as an integrated part of pre-loaded, two part epoxy cartridges, which heats them in a controlled manner for spray application. Further, the heating assembly is configured and arranged to be reinforced to resist pressure deformation and to facilitate easy spray application of material having a much higher viscosity than was possible in the prior art.

In the prior art epoxy is loaded into cartridges having two dispensing tubes arranged side by side wherein the size of the two tubes is proportional to the mixing formula of the epoxy wherein one tube is usually smaller and one is larger. This allows two cartridges to neatly nest with one another within a rectangular space wherein the cartridges are flipped relative to one another such that the larger diameter tubes are positioned adjacent the smaller diameter tubes. The cartridges are placed into a piston system that applies pressure to the plungers in the cartridges to force the epoxy out of the mixing nozzle end of the gun at elevated pressure. The prior art cartridges, when heated to the temperatures needed to reduce the viscosity of the epoxy material would undergo wall deformation and allow epoxy to leak at the rear of the cartridge past the plunger seals.

Figure 1:
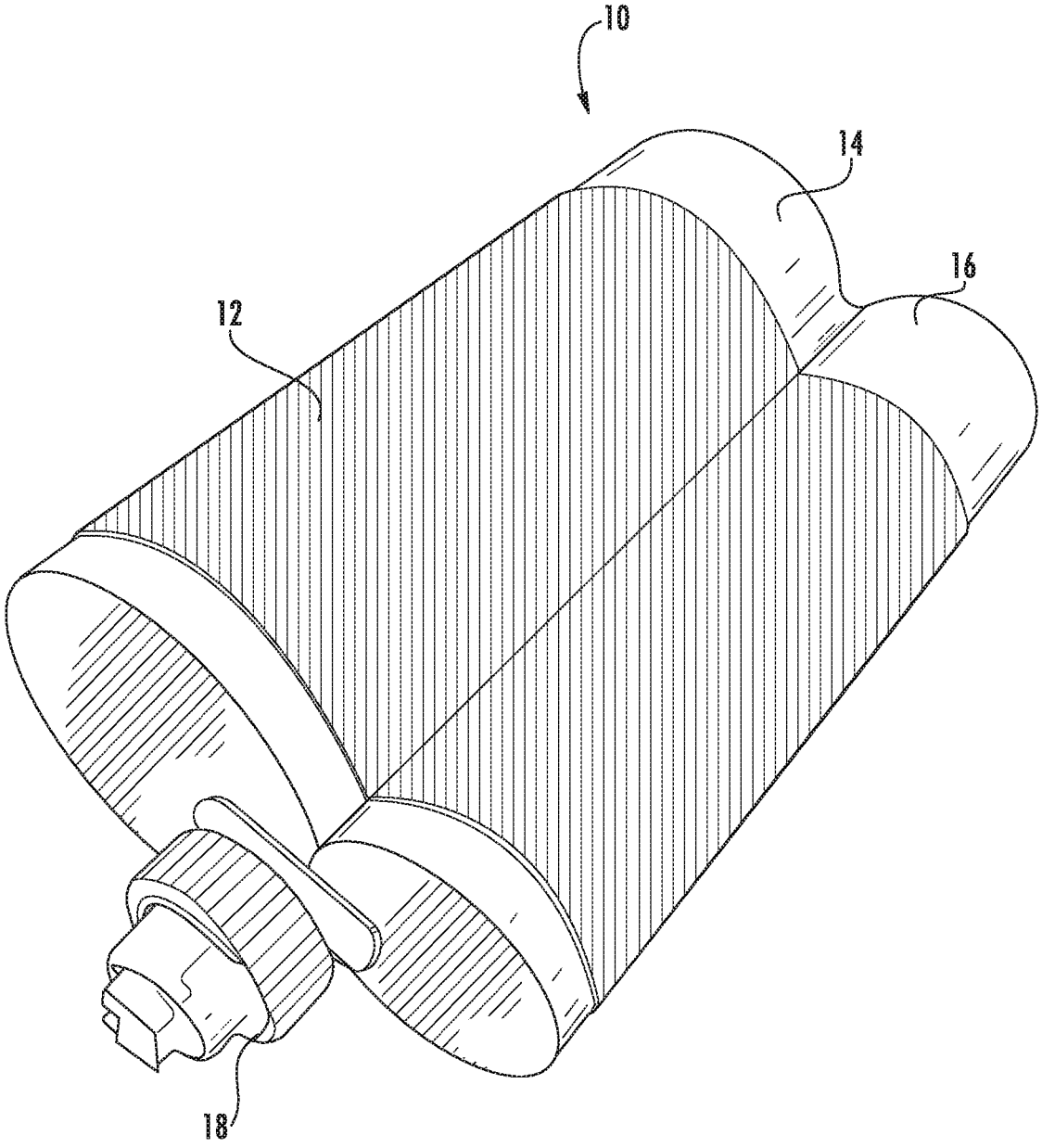
FIG. 1 is a perspective view of a dispensing cartridge in accordance with a first embodiment of the present invention.

The present invention provides an improved cartridge 10 structure that both heats the materials contained therein and provides for enhanced structure such that the bypass leaking of the low viscosity heated components is avoided. The cartridge is preferably formed from a rigid material such as reinforced fiberglass tubing. The wall of the cartridge is then wrapped in a flexible heating element 12 or has a heating element cast directly in the wall thereof. Turning to FIG. 1, a first embodiment is shown wherein an epoxy cartridge 10 is provided having two tubes 14, 16 interconnected with one another. At one end is a pair of nozzles 18 for dispensing proportional amounts of the two epoxy parts contained therein. About the exterior of the tubes 14, 16 can be seen a flexible heating element 12 that wraps the tubes 14, 16 and heats the epoxy components contained therein.

The heating elements can be rigid construction or of flexible construction as known in the art. The heating elements may be powered using conventional line voltage, i.e. 110 v, or through a car adapter operating at 12V DC. The heating elements preferably heat the interior contents and epoxy cartridges to between 150 degrees and 180 degrees Fahrenheit. More preferably the heating elements heat the contents of the cartridge to between 165 degrees and 180 degrees Fahrenheit.

Figure 2:
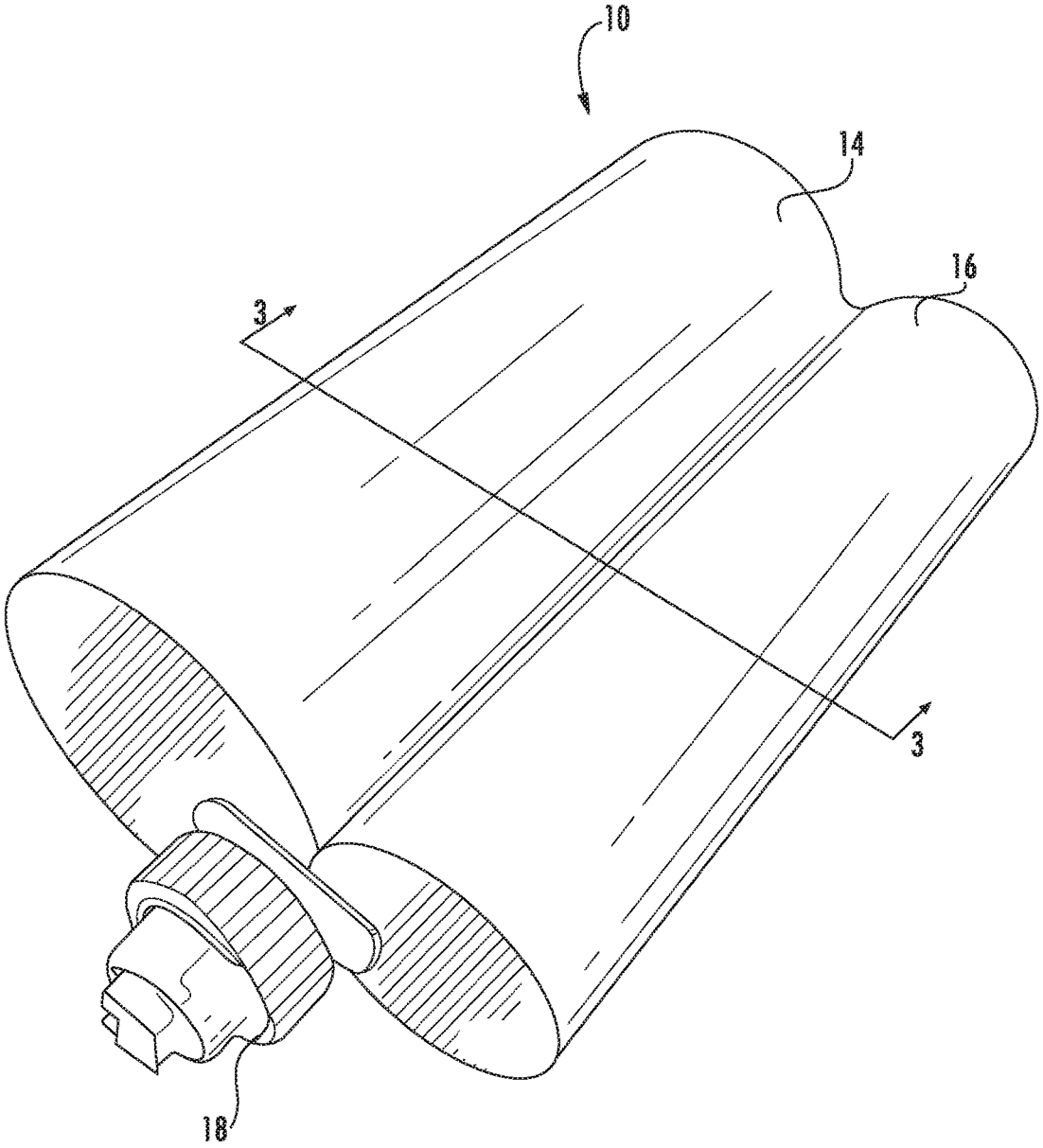
FIG. 2 is a perspective view of a dispensing cartridge in accordance with a second embodiment of the present invention.
Figure 3:
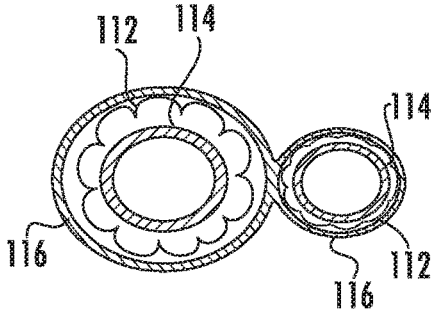
FIG. 3 is a cross-sectional view through the line 3-3 of FIG. 2.

The wall structure may be of single wall construction with the heaters embedded therein or as shown in FIGS. 2 and 3, of a double wall construction such that the heaters 112 are contained between an inner wall 114 and outer wall 116. Further, the wall construction is preferably formed to withstand the pressures applied when spray applying the epoxy contained therein to prevent the tube wall deformation and resulting blow by leakage. Further the walls are constructed to retain their structural properties at the operational temperatures of the heated epoxy at or above 180 degrees Fahrenheit. Preferably the wall construction is a reinforced polymer. More particularly the wall construction is preferably a glass reinforced fiberglass. By reinforcing these tubes in this manner the walls of the tube remain dimensionally stable under pressure and when heated to the operational temperatures described herein. This prevents the epoxy components contained therein from bleeding back through the seals at the plungers in the rear of the tube.

The cartridges heated in this manner are not subjected to burning as was the case in the use of prior art heating belts and is maintained in a heated useable form through the duration of the job while not requiring multiple cartridges to be heated one at a time prior to immediate use. In this manner the cartridges are maintained at the optimal temperature such that the contents are of a viscosity that spray application is uniform and consistent.

Accordingly, the present invention contemplates a new and improved apparatus and method for heating high build structural epoxy materials preparatory to use which overcomes all of the above referred problems and others. The device permits the material to be heated in a relatively short period of time. Furthermore, due to the configuration of the apparatus and method of heating, none of the material is burned; consequently the device is economically desirable.

Various other components may be included and called upon for providing for aspects of the teachings herein. For example, additional materials, combinations of materials and/or omission of materials may be used to provide for added embodiments that are within the scope of the teachings herein.

In the present application a variety of embodiments are described. It is to be understood that any combination of any of these variables can define an embodiment of the invention. For example, a combination of a particular dopant material, with a particular compound, applied in a certain manner might not be expressly stated, but is an embodiment of the invention. Other combinations of articles, components, conditions, and/or methods can also be specifically selected from among variables listed herein to define other embodiments, as would be apparent to those of ordinary skill in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A portable cartridge for containing and handheld dispensing a two-part epoxy material, comprising:

two tubular compartments for containing each of the two epoxy components;

proportional dispenser spouts positioned at an end of each of the tubular compartments; and a heating element disposed integral to an outer surface of the tubular compartments, said heating element maintaining said epoxy components within said tubular compartments between 150 degrees and 180 degrees Fahrenheit.

2. The cartridge of claim 1, wherein said heating element operates on 12 v DC.

3. The cartridge of claim 1, wherein said heating element operates 110 v AC.

4. The cartridge of claim 1, wherein said heating element maintains the epoxy components at an optimal temperature range such that the viscosity of the epoxy facilitates spray application for high build coatings.

5. The cartridge of claim 1, wherein a side wall of said two tubular compartments is reinforced in a manner that prevents deformation of said sidewall at the operational temperatures and pressures of said cartridge.

6. The cartridge of claim 5, wherein said side wall is formed from glass reinforced fiberglass.

7. A portable cartridge for containing and handheld dispensing a two-part epoxy material, comprising:

two tubular compartments for containing each of the two epoxy components;

proportional dispenser spouts positioned at an end of each of the tubular compartments; and a heating element disposed in a cavity formed within a sidewall of the tubular compartments, said heating element maintaining said epoxy components within said tubular compartments between 150 degrees and 180 degrees Fahrenheit.

8. The cartridge of claim 7, wherein said heating element operates on 12 v DC.

9. The cartridge of claim 7, wherein said heating element operates 110 v AC.

10. The cartridge of claim 7, wherein said heating element maintains the epoxy components at an optimal temperature range such that the viscosity of the epoxy facilitates spray application for high build coatings.

11. The cartridge of claim 7, wherein a side wall of said two tubular compartments is reinforced in a manner that prevents deformation of said sidewall at the operational temperatures and pressures of said cartridge.

12. The cartridge of claim 11, wherein said side wall is formed from glass reinforced fiberglass.

* * * * *